US006733425B2

(12) United States Patent
Blackford et al.

(10) Patent No.: US 6,733,425 B2
(45) Date of Patent: May 11, 2004

(54) EXERCISE SYSTEM

(76) Inventors: Richard Blackford, 728 Serata St., Venice, FL (US) 34285; Harry Orlish, 1395 Escalante Dr., Prescott, AZ (US) 86303; Jeff Faulkner, 6602 N. 181st. Avenue, Waddell, AZ (US) 85355

( * ) Notice: Subject to any disclaimer, the term of this patent is extended or adjusted under 35 U.S.C. 154(b) by 311 days.

(21) Appl. No.: 10/061,486

(22) Filed: Feb. 4, 2002

(65) Prior Publication Data

US 2003/0148864 A1 Aug. 7, 2003

(51) Int. Cl.[7] ..... A63B 21/008; A61F 2/00

(52) U.S. Cl. ..... 482/112; 600/29

(58) Field of Search ..... 482/148, 124, 482/128, 112–113; 604/500; 128/836, 884, 838, 840, 830, 846; 600/38, 29

(56) References Cited

U.S. PATENT DOCUMENTS 2,638,093 A * 5/1953 Kulick ..... 600/29
2,769,442 A * 11/1956 Stubbs ..... 128/836
3,687,458 A * 8/1972 Proctor ..... 473/204
4,572,503 A * 2/1986 Myung Ho ..... 482/82
5,372,557 A * 12/1994 Ostigny ..... 482/49
5,865,715 A * 2/1999 Wallick ..... 482/124
6,258,015 B1 * 7/2001 Blackford et al. ..... 482/124

* cited by examiner

*Primary Examiner*—Stephen R. Crow
(74) *Attorney, Agent, or Firm*—Edward P. Dutkiewicz

(57) ABSTRACT

An exercise system comprising a main subassembly having a rounded conically shaped tip, a rounded upper surface and a flattened recessed lower surface. The main subassembly has a cantilever beam. The main subassembly has a hinge. Next provided is a lower subassembly. The lower subassembly has a slot with a plurality of recesses. The lower subassembly has a hinge to couple with the hinge of the main subassembly. Next provided is an adjustment subassembly having a dome and a locking pin. The adjustment subassembly allows the user to loosen and lock the dome to thereby alter the resistance to movement. Next provided is a bellows with a nipple. Next provided is a cycle counter and resistance feedback mechanism subassembly with a pneumatic actuator and counter device. Lastly provided is a flexible tube coupling the bellows and the actuator for the transmission of the pneumatic force from the bellows to the actuator.

4 Claims, 4 Drawing Sheets

FIG 7
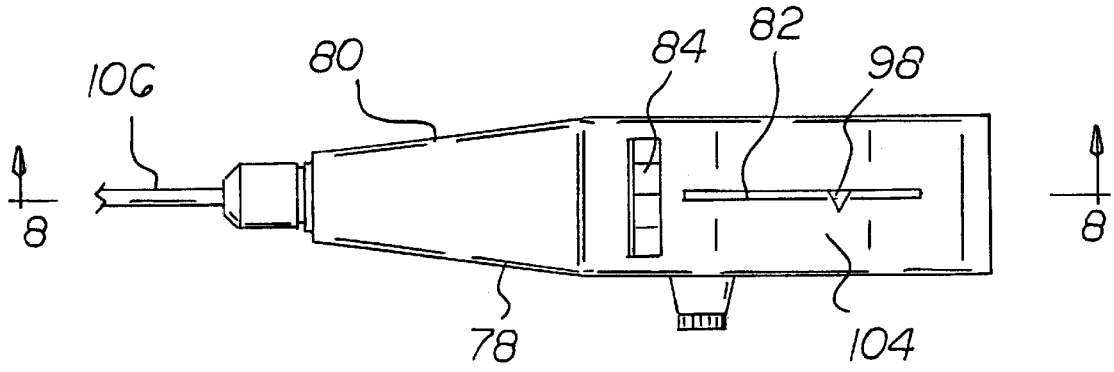
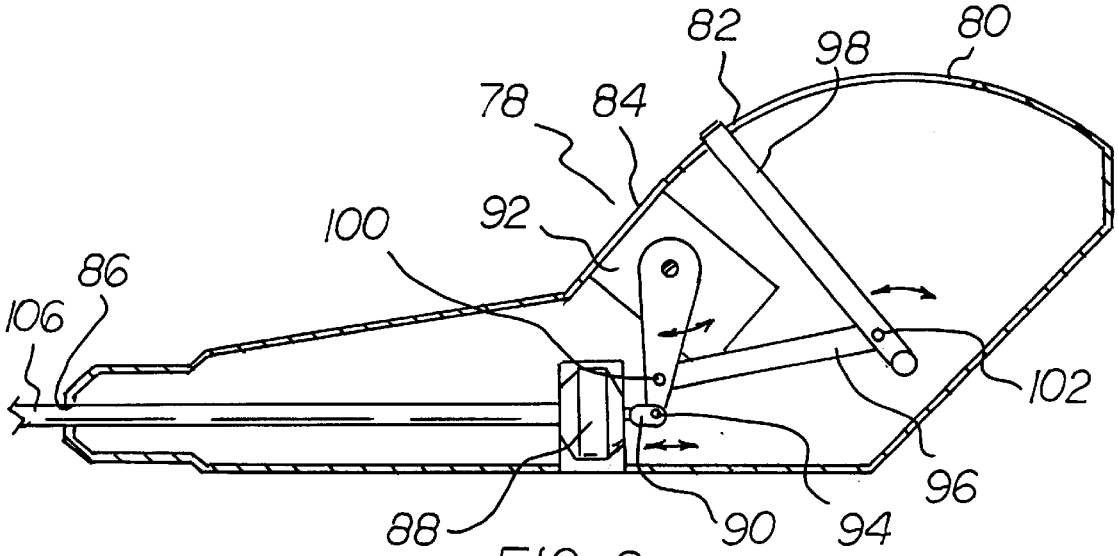
FIG 8

EXERCISE SYSTEM

BACKGROUND OF THE INVENTION

1. Field of the Invention

The present invention relates to an exercise system and more particularly pertains to allowing the user to strengthen the pelvic muscles in a safe and convenient manner.

2. Description of the Prior Art

The use of known methods and apparatuses is known in the prior art. More specifically, known methods and apparatuses previously devised and utilized for the purpose of strengthening pelvic muscles are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,258,015 B1 issued to Blackford et al on Jul. 10, 2001 discloses an exercise device. U.S. Pat. No. 5,865,715 issued to Wallick on Feb. 2, 1999 discloses a contraction resistance vaginal muscle exerciser.

While these devices fulfill their respective, particular objectives and requirements, the aforementioned patents do not describe exercise system that allows allowing the user to strengthen the pelvic muscles in a safe and convenient manner.

In this respect, the exercise system according to the present invention substantially departs from the conventional concepts and designs of the prior art, and in doing so provides an apparatus primarily developed for the purpose of allowing the user to strengthen the pelvic muscles in a safe and convenient manner.

Therefore, it can be appreciated that there exists a continuing need for a new and improved exercise system which can be used for allowing the user to strengthen the pelvic muscles in a safe and convenient manner. In this regard, the present invention substantially fulfills this need.

SUMMARY OF THE INVENTION

In view of the foregoing disadvantages inherent in the known types of known methods and apparatuses now present in the prior art, the present invention provides an improved exercise system. As such, the general purpose of the present invention, which will be described subsequently in greater detail, is to provide a new and improved exercise system and method which has all the advantages of the prior art and none of the disadvantages.

To attain this, the present invention essentially comprises an exercise system for allowing the user to strengthen the pelvic muscles in a safe and convenient manner. The system comprises several components, in combination. First provided is a main subassembly. The main subassembly is fabricated of rigid material and has an generally rounded upper surface. It has a generally flattened lower surface with an outboard portion and an inboard portion. There is a middle portion there between. The outboard portion has a rounded conically shaped tip. The middle portion has a rounded upper surface and a flattened recessed lower surface. The inboard portion has a rounded upper surface and a flattened lower surface. There is a greater upper to lower diameter on the outboard end and a lesser upper to lower diameter at the inboard end. There is also a cantilever beam protruding inboardly from the outboard end of the inboard portion. The cantilever beam functions in conjunction with the dome to provide an adjustable point of leverage from which a plurality of resistances may be generated. The main subassembly has a hinge located at the inboard end. Next provided is a lower subassembly fabricated of rigid material. The lower subassembly has an generally rounded lower surface and a generally flattened upper surface. It has an outboard portion and an inboard portion. The inboard portion has a slot with a plurality of recesses running lengthwise. The slot is located at about the middle of, and through, the inboard portion. The subassembly has a hinge at the inboard most end to mate with and couple with the hinge of the main subassembly. Next provided is an adjustment subassembly. The adjustment subassembly is fabricated of a rigid material and has a dome with a central recess, and a locking pin with flat head and a smooth round shaft, and a retaining means to couple the dome and pin together. It also has a spring to maintain the pin in an outward position. The subassembly allows the user to loosen and lock the dome along the length of the slot on the lower subassembly in any one of a plurality of locations along the slot. This positioning allows the dome to contact with the cantilever beam in a plurality of locations and thereby alters the resistance to movement. Next provided is a bellows made of a flexible resilient material having a downward end and an upward end with a nipple. Next provided is a cycle counter and resistance feedback mechanism subassembly. It has a hollow case with a slot, a counter window, and a tube passageway. The subassembly has an internal mechanism with an actuator for transforming pneumatic force into mechanical force. There is also a first connecting arm and a repetition counter with a coupling means for holding the first connecting arm and repetition counter arm in a constant two plane orientation. There is also a second connecting arm and magnitude meter with the second connecting arm being coupled with the repetition counter in a constant two plane orientation by a coupling means. The second connecting arm is also coupled with the magnitude meter in a constant two plane orientation by a coupling means. The magnitude meter is located within the case slot. The case has a measurement scale affixed to the outside of the case to allow the user to assess muscular improvement. Lastly provided is a flexible tube coupling the bellows and the actuator for the transmission of the pneumatic force from the bellows to the actuator.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise system which has all of the advantages of the prior art known methods and apparatuses and none of the disadvantages.

It is another object of the present invention to provide a new and improved exercise system which may be easily and efficiently manufactured and marketed.

It is further object of the present invention to provide a new and improved exercise system which is of durable and reliable constructions.

An even further object of the present invention is to provide a new and improved exercise system which is susceptible of a low cost of manufacture with regard to both materials and labor, and which accordingly is then susceptible of low prices of sale to the consuming public, thereby making such exercise system economically available to the buying public.

Even still another object of the present invention is to provide a exercise system for allowing the user to strengthen the pelvic muscles in a safe and convenient manner.

Lastly, it is an object of the present invention to provide a new and improved exercise system comprising a main subassembly having a rounded conically shaped tip, a rounded upper surface and a flattened recessed lower surface. The main subassembly has a cantilever beam. The main subassembly has a hinge. Next provided is a lower subassembly. The lower subassembly has a slot with a plurality of recesses. The lower subassembly has a hinge to couple with the hinge of the main subassembly. Next provided is an adjustment subassembly having a dome and a locking pin. The adjustment subassembly allows the user to loosen and lock the dome to thereby alter the resistance to movement. Next provided is a bellows with a nipple. Next provided is a cycle counter and resistance feedback mechanism subassembly with a pneumatic actuator and counter device. Lastly provided is a flexible tube coupling the bellows and the actuator for the transmission of the pneumatic force from the bellows to the actuator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a planar view of the measuring subassembly of the exercise system.

FIG. 8 is a longitudinal cross section of the measuring subassembly taken along line 8—8 of FIG. 7.

The same reference numerals refer to the same parts throughout the various Figures.

DESCRIPTION OF THE PREFERRED EMBODIMENT

Figure 1:
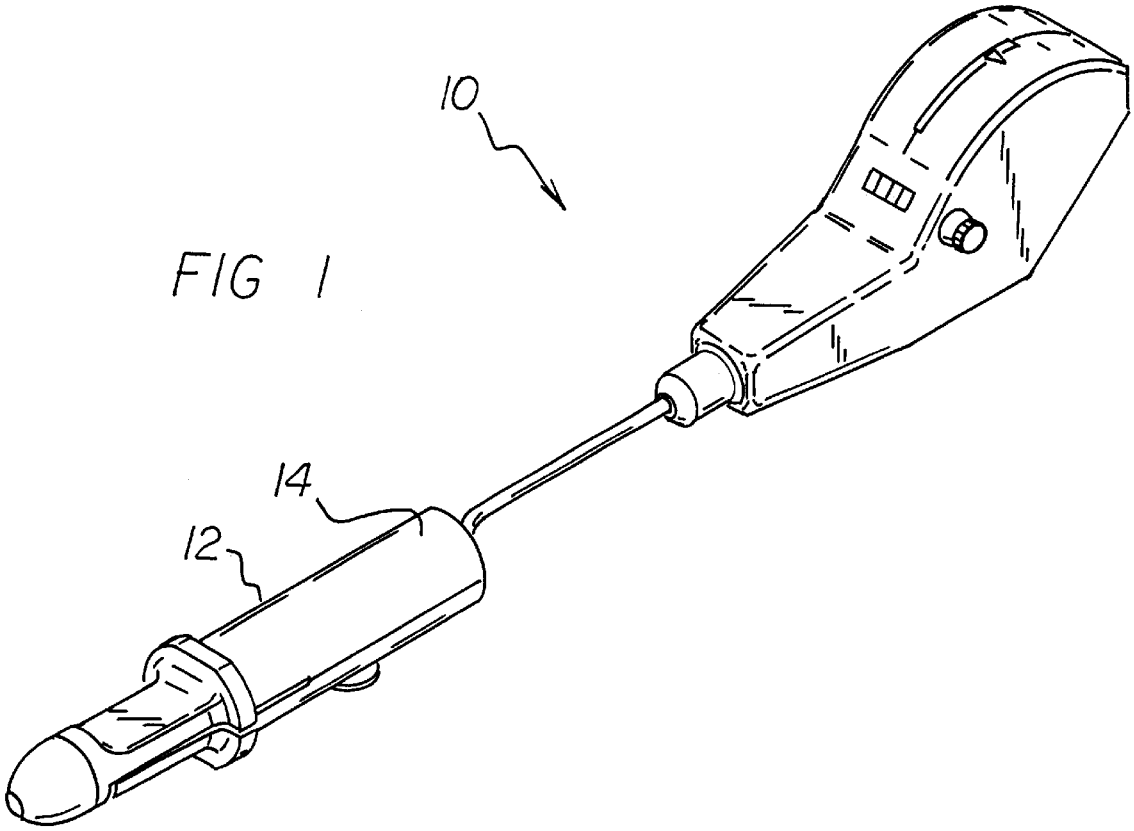
FIG. 1 is a perspective view of the device.
Figure 2:
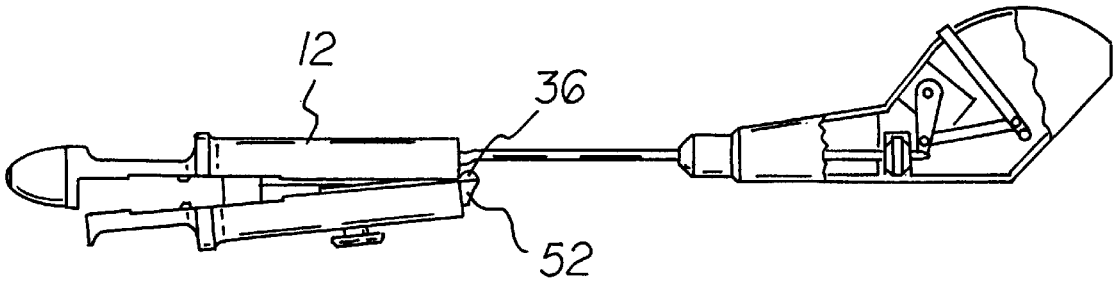
FIG. 2 is a side elevation showing the interior of the hollow case and the exerciser in the open position.
Figure 3:
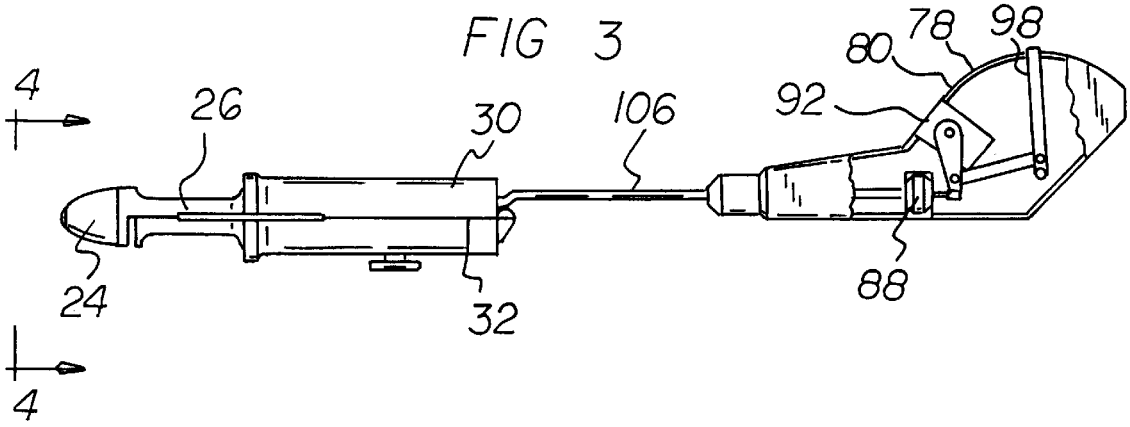
FIG. 3 is a side elevation showing the interior of the hollow case and the exerciser is in the closed position.
Figure 4:
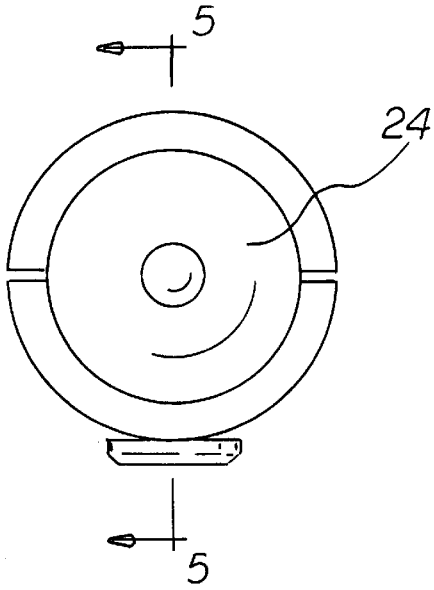
FIG. 4 is a frontal elevation of the tip of the exerciser taken along line 4—4 of FIG. 3.
Figure 5:
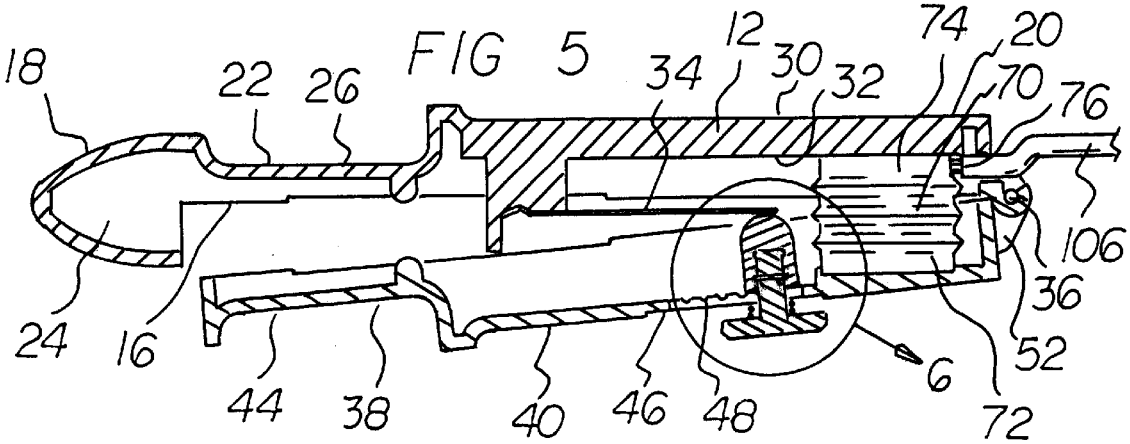
FIG. 5 is a longitudinal cross section view of the exerciser.
Figure 6:
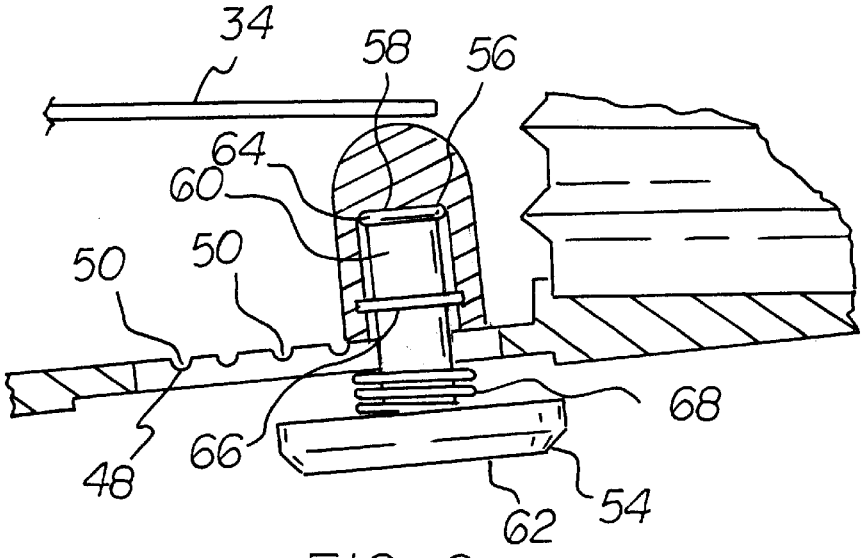
FIG. 6 is a close up view of the dome and pin and cantilever taken in circle 6 of FIG. 5.

With reference now to the drawings, and in particular to FIG. 1 thereof, the preferred embodiment of the new and improved exercise system embodying the principles and concepts of the present invention and generally designated by the reference numeral 10 will be described.

The present invention, the exercise system 10 is comprised of a plurality of components. Such components in their broadest context include a exerciser, a measuring subassembly and connecting tube. Such components are individually configured and correlated with respect to each other so as to attain the desired objective.

An exercise system 10 for allowing the user to strengthen the pelvic muscles in a safe and convenient manner. The system comprises several components, in combination.

First provided is a main subassembly 12. The main subassembly is fabricated of rigid material and has an generally rounded upper surface 14. It has a generally flattened lower surface 16 with an outboard portion 18 and an inboard portion 20. There is a middle portion 22 there between.

The outboard portion has a rounded conically shaped tip 24. The middle portion has a rounded upper surface 26 and a flattened recessed lower surface 28.

The inboard portion has a rounded upper surface 30 and a flattened lower surface 32. There is a greater upper to lower diameter on the outboard end and a lesser upper to lower diameter at the inboard end. There is also a cantilever beam 34 protruding inboardly from the outboard end of the inboard portion. The main subassembly has a hinge 36 located at the inboard end.

Next provided is a lower subassembly 38 fabricated of rigid material. The lower subassembly has an generally rounded lower surface 40 and a generally flattened upper surface 42. It has an outboard portion 44 and an inboard portion 46. The inboard portion has a slot 48 with a plurality of recesses 50. The slot is located at about the middle of, and through, the inboard portion and runs longitudinally. The subassembly has a hinge 52 at the inboard most end to mate with and couple with the hinge of the main subassembly.

Next provided is an adjustment subassembly 54. The adjustment subassembly is fabricated of a rigid material and has a dome 56 with a central recess 58, and a locking pin 60 with flat head 62 and a smooth round shaft 64, and a retaining means 66 to couple the dome and pin together. It also has a spring 68 to maintain the pin in an outward position.

The subassembly allows the user to loosen and lock the dome along the length of the slot on the lower subassembly in any one of a plurality of locations along the slot. This positioning allows the dome to contact with the cantilever beam in a plurality of locations and thereby alters the resistance to movement.

Next provided is a bellows 70 made of a flexible resilient material having a downward end 72 and an upward end 74 with a nipple 76.

Next provided is a cycle counter and resistance feedback mechanism subassembly 78. It has a hollow case 80 with a slot 82, and a counter window 84, and a tube passageway 86.

The subassembly has an internal mechanism with an actuator 88 for transforming pneumatic force into mechanical force. There is also a first connecting arm 90 and a repetition counter 92 with a coupling means 94 for holding the first connecting arm and repetition counter arm in a constant two plane orientation.

There is also a second connecting arm 96 and magnitude meter 98 with the second connecting arm being coupled with the repetition counter in a constant two plane orientation by a coupling means 100. The second connecting arm is also coupled with the magnitude meter in a constant two plane orientation by a coupling means 102.

The magnitude meter is located within the case slot. The case has a measurement scale 104 affixed to the outside of the case to allow the user to assess muscular improvement.

Lastly, provided is a flexible tube 106 coupling the bellows and the actuator for the transmission of the pneumatic force from the bellows to the actuator.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise system for allowing the user to strengthen the pelvic muscles in a safe and convenient manner, comprising, in combination;

a main subassembly fabricated of rigid material having an generally rounded upper surface and a generally flattened lower surface having an outboard portion and an inboard portion and a middle portion there between, the outboard portion having a rounded conically shaped tip with the middle portion having a rounded upper surface and a flattened recessed lower surface with the inboard portion having a rounded upper surface and a flattened lower surface with a greater upper to lower diameter on the outboard end and a lesser upper to lower diameter at the inboard end, with a cantilever beam protruding inboardly from the outboard end of the inboard portion, the main subassembly having a hinge located at the inboard end;

a lower subassembly fabricated of rigid material having an generally rounded lower surface and a generally flattened upper surface and having an outboard portion and an inboard portion having a slot with a plurality of recesses running lengthwise at about the middle of and through the inboard portion, the subassembly having a hinge at the inboard most end to mate with and couple with the hinge of the main subassembly;

an adjustment subassembly which is fabricated of a rigid material having a dome with a central recess and a locking pin with flat head and a smooth round shaft, and a retaining means to couple the dome and pin together and a spring to maintain the pin in an outward position, the subassembly allowing the user to loosen and lock the dome along the length of the slot on the lower subassembly in any one of a plurality of locations along the slot allowing the dome to contact with the cantilever beam in a plurality of locations and thereby alter the resistance to movement;

a bellows made of a flexible resilient material having a downward end and an upward end with a nipple;

a cycle counter and resistance feedback mechanism subassembly having a hollow case with an inside surface and an outside surface, the case having a slot and a counter window and a tube passageway, with the subassembly having an internal mechanism having an actuator for transforming pneumatic force into mechanical force and a first connecting arm and a repetition counter with a coupling means for holding the first connecting arm and repetition counter arm in a constant two plane orientation, and a second connecting arm and magnitude meter with the second connecting arm being coupled with the repetition counter held in a constant two plane orientation by a coupling means and the second connecting arm also coupled with the magnitude meter in a constant two plane orientation by a coupling means with the outward arm of the magnitude meter being located within the case slot with the case having a measurement affixed to the outside of the case to allow the user to assess muscular improvement; and a flexible tube coupling the bellows and the actuator for the transmission of the pneumatic force from the bellows to the actuator.

2. An exercise system comprising;

a main subassembly having a rounded conically shaped tip and a rounded upper surface and a flattened recessed lower surface, with a cantilever beam, the main subassembly having a hinge;

a lower subassembly with a slot with a plurality of recesses and a hinge to couple with the hinge of the main subassembly;

an adjustment subassembly having a dome with a recess and a locking pin, the subassembly allowing the user to loosen and lock the dome to thereby alter the resistance to movement;

a bellows with a nipple;

a cycle counter and resistance feedback mechanism subassembly with a pneumatic actuator and counter device; and, a flexible tube coupling the bellows and the actuator for the transmission of the pneumatic force from the bellows to the actuator.

3. An exercise system as described in claim 2 wherein the adjustment subassembly further comprises a spring clip coupling means to retain the pin within the dome recess.

4. An exercise system as described in claim 2 wherein the system further comprises a spring to maintain the pin and dome engaged within any one of the plurality of recesses in the lower subassembly.

* * * * *